US006738997B2

(12) United States Patent
Patella

(10) Patent No.: US 6,738,997 B2
(45) Date of Patent: May 25, 2004

(54) MECHANISM FOR A DIVAN BED

(75) Inventor: Pino Patella, Altamura (IT)

(73) Assignee: Gruppo Industriale Styling SRL, Altamura (IT)

( * ) Notice: Subject to any disclaimer, the term of this patent is extended or adjusted under 35 U.S.C. 154(b) by 0 days.

(21) Appl. No.: 10/220,234

(22) PCT Filed: Sep. 17, 2001

(86) PCT No.: PCT/IB01/01694

§ 371 (c)(1),
(2), (4) Date: Dec. 11, 2002

(87) PCT Pub. No.: WO02/054915

PCT Pub. Date: Jul. 18, 2002

(65) Prior Publication Data

US 2004/0034928 A1 Feb. 26, 2004

(30) Foreign Application Priority Data

Jan. 16, 2001 (IT) ..... BA2001-A0006

(51) Int. Cl.[7] ..... A47C 17/17

(52) U.S. Cl. ..... 5/37.1; 5/57.1; 5/57.2; 5/47

(58) Field of Search ..... 5/37.1, 41, 47, 5/48, 57.1, 57.2

(56) References Cited

U.S. PATENT DOCUMENTS 2,539,812 A * 1/1951 Carrick ..... 5/57.1
2,601,683 A * 7/1952 Bebry et al. ..... 5/57.1
2,796,615 A * 6/1957 Harman ..... 5/47
3,247,527 A * 4/1966 Mizelle ..... 5/57.1
3,844,608 A * 10/1974 Freedman ..... 297/92

FOREIGN PATENT DOCUMENTS

DE 8605100 U1 * 5/1986
DE 29909973 U1 * 8/1999
DE 198288224 C1 * 12/1999
EP 0807390 A2 * 11/1997

* cited by examiner

*Primary Examiner*—Michael F. Trettel
(74) *Attorney, Agent, or Firm*—Herbert Dubno

(57) ABSTRACT

Innovative mechanism for a divan bed enabling the adjustment in three positions, said "divan", "relax" and "bed", comprising padding elements supported by two frames; said frames can reciprocally move by means of two angle-bars, concurrent in a point; one of said angle-bars supports the frame forming the seat of the divan bed and the second one supports the frame forming the back of the divan bed; moreover comprising an articulated quadrilateral which supports said second angle-bar. The mechanism is characterised in that the angle-bars constitute a release mechanism which enables the three positions, stable respect to the divan bed base, while the quadrilater stiffly moves the angle-bars in other three positions.

Therefore, the main feature of the mechanism is the univocal positioning between the angle-bars and the quadrilateral elements, without any other additional element as, for example, stop elements like ratchet or pawl.

4 Claims, 3 Drawing Sheets

MECHANISM FOR A DIVAN BED

CROSS REFERENCE TO RELATED APPLICATION

This application is a national phase of PCT/IB01/01694 filed Sep. 17, 2001 and is based upon Italian national application BA 2001 A 000006 of Jan. 16, 2001 under the International Convention.

FIELD OF THE INVENTION

The present invention relates to a mechanism for divan beds enabling the adjustment of a divan bed into three positions, "bed", "divan" and "relax".

BACKGROUND OF THE INVENTION

In the state of the art concerning the above mentioned applications, there are already mechanisms enabling the adjustment into three positions of a divan bed. Such mechanisms, as the ones described in the European patents 0 380 156 and 0 807 390, are generally release mechanisms comprising two reciprocally moving angle bars, a kinematics similar to that of an articulated quadrilateral, some elements forming a seat and a pawl to lock the divan bed in the "divan" and "relax" positions, and at least two toothed profiles that, engaging with each other, determine the reciprocal position of the angle-bars and, also, the position of the frames supporting the divan bed.

The known applications, however, are characterized by many constructive disadvantages. The described kinematic system is very complicated by the high number of components and hinges; the toothed profiles do not work properly because they are tangentially stressed and not axially stressed.

SUMMARY OF THE INVENTION

The invention is different from the devices on the market thanks to the fact that the same angle-bars (joining the frames of the divan bed) are the elements of a release mechanism which enables the three positions to be obtained, but which is stable respect to the divan bed base, while the articulated quadrilateral stiffly moves the angle-bars into the other three positions.

The main feature of the mechanism is the unequivocal positioning between the angle-bars and the quadrilateral elements, without any other additional element as, for example, stop elements, like a ratchet or pawl.

Another object of the invention is a substantial reduction of the number of the hinges, to a number that does not exceed five, as will be seen from the detailed description.

BRIEF DESCRIPTION OF THE DRAWING

These and other advantages will be pointed out in the detailed description of the invention that will refer to the drawing in which the preferred mechanism is shown in the three different positions.

In the drawing

SPECIFIC DESCRIPTION

Figure 1:
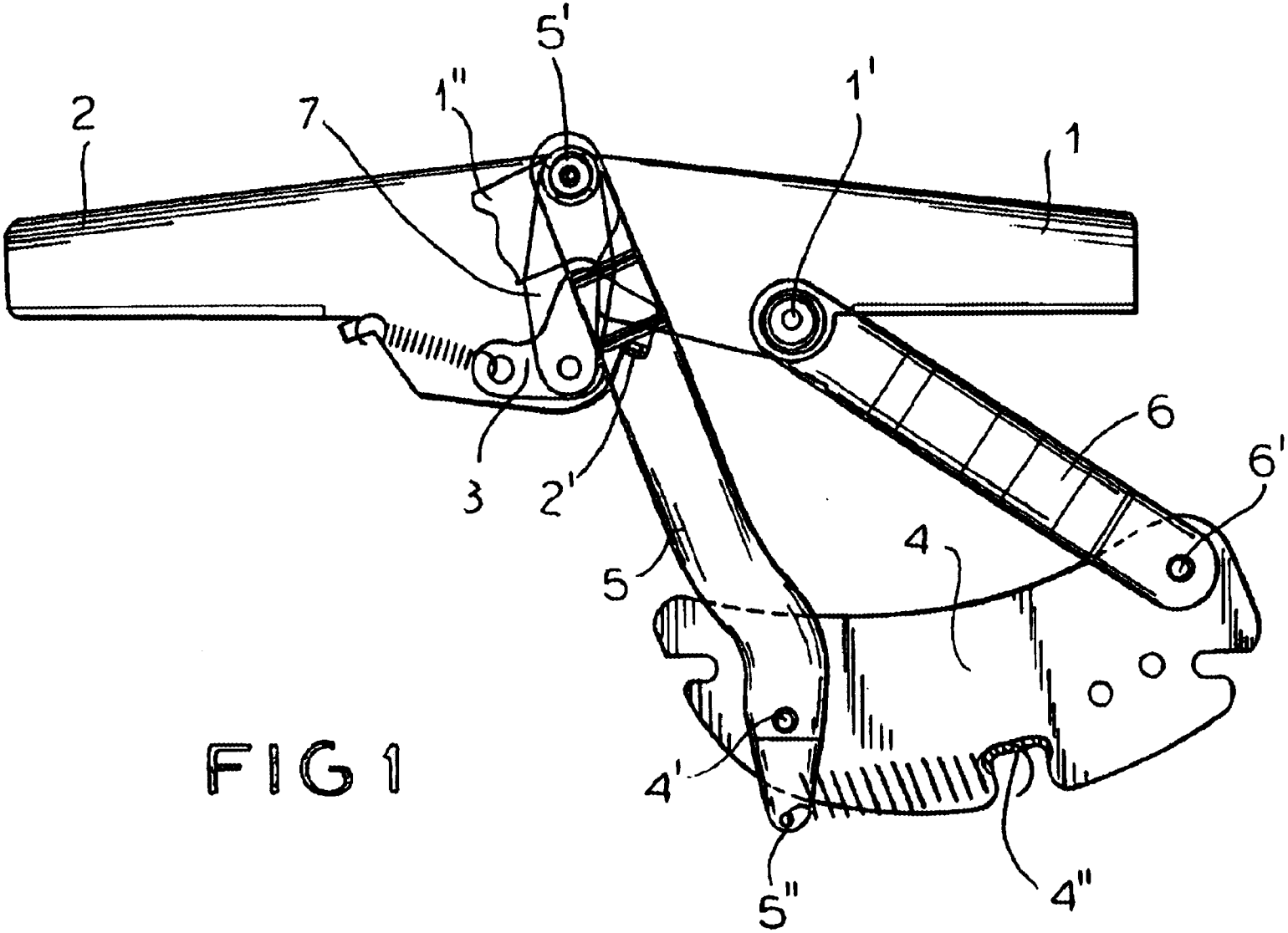
FIG. 1 shows the mechanism in "bed" position.
Figure 2:
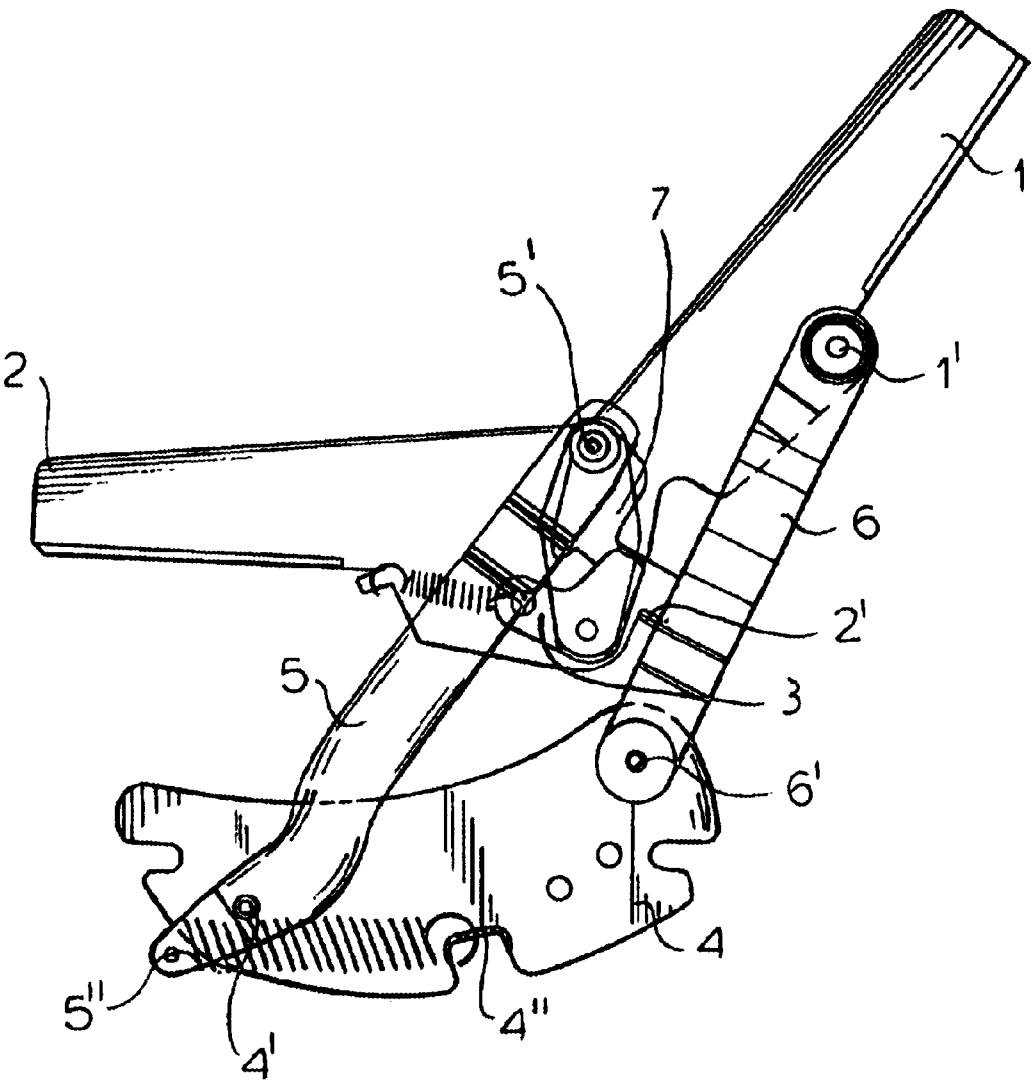
FIG. 2 represents the "relax" position.
Figure 3:
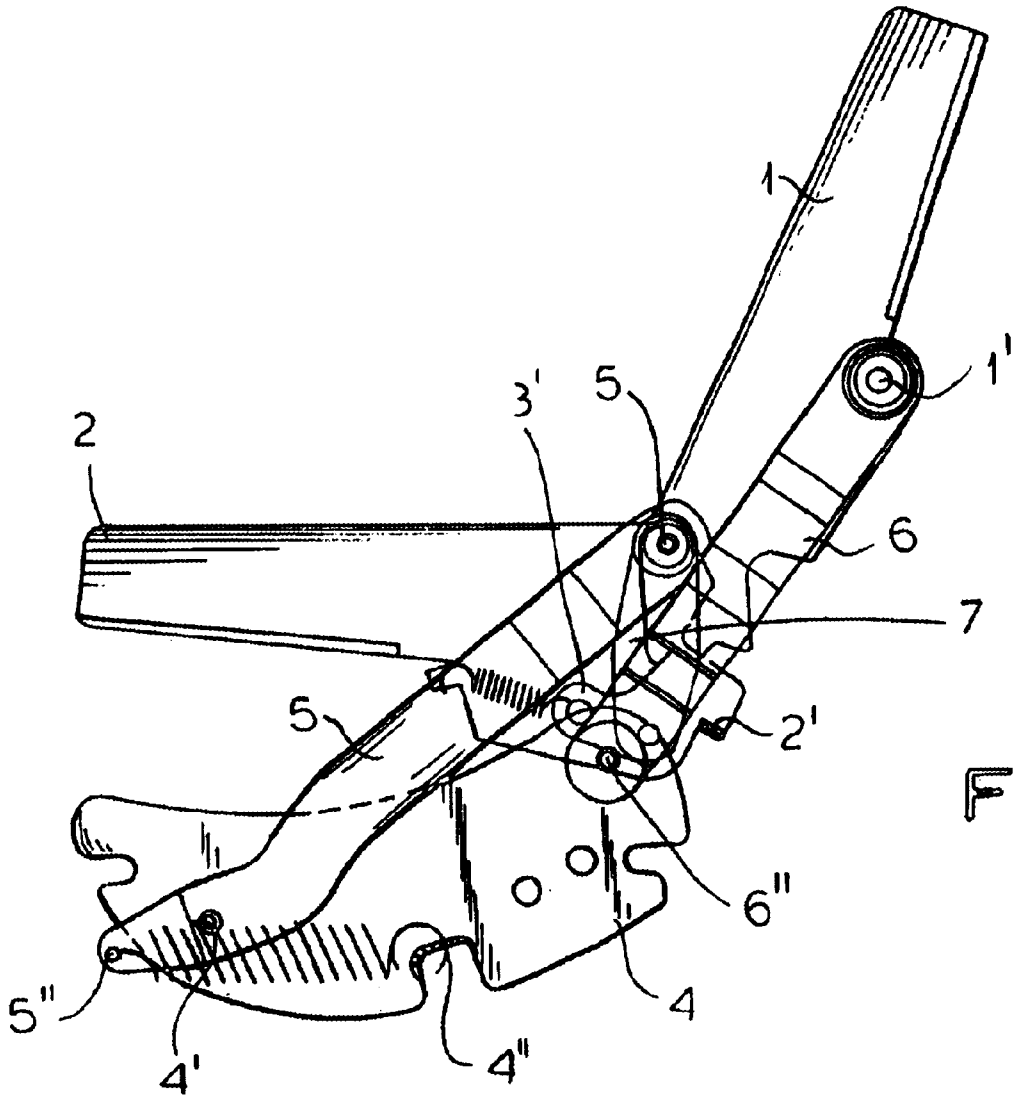
FIG. 3 shows the "divan" position can be observed.

With reference to these figures, the present mechanism enables the adjustment of two padded frames, forming the seat and the back of a divan bed. Due to their reciprocal position and to their position toward to the divan base, said frames can be placed in three configurations, called "divan", "relax" and "bed" positions.

The frames are connected to the mechanism by means of the angle bars 1, 2, which are hinged by the joint 5'. The reciprocal motion of the angle bars is a rotation respect to the hinge axis. The reciprocal position of the two angle bars is realized by a cyclic, not reversible release mechanism, which enables the three stable positions to be obtained.

The release mechanism comprises the angle bar end 1, a cam 3 and an elastic means which retains the cam 3. The angle bar 1 (supporting the back frame) and the angle bar 2 (supporting the seat frame) are joined without interposition of additional elements so that the cam 3 lays in the same plane of the angle bar toothed end 1"; this coplanarity is further assured by the fixing plate 7. Cam 3 has a contact surface, which alternatively engages the angle bar toothed surface 1", so univocally fixing the reciprocal position of the angle-bars and the related frames. To assure the divan bed optimal ergonomics, the two angle bars can be placed in three stable positions with respect to the divan base. These positions are realized by means of a quadrilateral composed of angle bar 1, front lever 5, a fixing plate of the divan base 4 and the back lever 6; such quadrilateral is articulated at the nodes or pivot points 1', 5', 4', 6'.

Therefore, while the release mechanism enables three angle bar reciprocal positions, the quadrilateral stiffly moves the angle bars into the others of the three positions. The main feature of this mechanism is the relation between the angle bars positioning and the quadrilateral positions. In other words, kinematically a correspondence exists between the angle bars' "divan" position and the quadrilateral's "divan" position, between the angle-bars' "relax" position and the quadrilateral's "relax" position and finally between the angle-bars' "bed" position and the quadrilateral's "bed" position. In fact, when the angle-bars are in the "relax" position, the only stable configuration of the quadrilateral is reached when the angle bar stop element 2' touches the back lever 6. The angle bar 2 and the back lever 6 are shaped so that the contact between the lever 6 and the angle bar surface 2' can occur only if the two angle bars are in the reciprocal position called "relax". If the angle-bars are in the "divan" position, no contact can occur between the angle bar stop element 2' and the back lever 6; therefore, this configuration forces the quadrilateral to assume the only stable "divan" position when the front lever 5 touches the back lever 6. Finally, in the "bed" position, the angle bars are aligned and the stable configuration is obtained by means of the contact between the frames and the divan base. In such configuration, at the same time, the quadrilateral assures the contact between the frames and the divan base and the frame alignment.

As it is evident, this mechanism is extremely simple, capable of performing, in an effective way, functions which up to now have been performed only by very complex mechanisms with a large number of components. In particular, the invention is quite different from the others, known as prior art, because it needs only five hinges. This is possible thanks to the fact that the hinge 5' (normally articulating the two angle-bars) has been also used as hinge between angle-bar and quadrilateral. Moreover, said hinge 5' has been further lowered respect to the sleeping level: therefore a single padding can be used for the whole divan bed avoiding the padding's wear due to the mechanism.

What is claimed is:

1. A divan bed mechanism comprising:

a first angle bar adapted to support a seat of a divan bed;

a second angle bar pivotally connected to said first angle bar at an end thereof at a first pivot point and adapted to support a frame forming a back of the divan bed;

a front lever swingable about said first pivot point at one end of said front lever and having a second pivot point at another end of said front lever;

a rear lever swingable about a third pivot point on said second angle bar and spaced thereon from said first pivot point, said rear lever lying in a common plane with said front lever such that said front lever directly abuts said rear lever in a divan position of the divan bed to firmly support said angle bars in said divan position, said rear lever having a fourth pivot point spaced along said rear lever from said third pivot point;

a fixing plate on a base of the divan bed to which said front lever is articulated at said second pivot point and said rear lever is articulated at said fourth pivot point whereby said second angle bar between said first and third pivot point, said levers and said fixing plate form a quadrilateral defining said divan position, a relaxed position in which said first and second angle bars include a greater angle between them than is formed by said angle bars in said divan position, and a bed position; and a cam pivotal on said first angle bar and engageable with a toothed portion of said second angle bar for releasably retaining said front and rear levers in said relaxed position, said quadrilateral and said cam exclusively maintaining said angle bars in said rest and divan positions.

2. The mechanism defined in claim 1, further comprising a spring connected between said cam and said first angle bar for biasing said spring toward said toothed portion of said second angle bar.

3. The mechanism defined in claim 2, further comprising a spring connected between a portion of said front lever spaced from said second pivot point away from said first pivot point and to said fixing plate.

4. The mechanism defined in claim 3 wherein said cam is coplanar with said toothed portion.

* * * * *